US008515304B2

(12) United States Patent
Hagiwara et al.

(10) Patent No.: US 8,515,304 B2
(45) Date of Patent: Aug. 20, 2013

(54) CLEANING MEMBER FOR IMAGE FORMING APPARATUS, CHARGING DEVICE, PROCESS CARTRIDGE, AND IMAGE FORMING APPARATUS

(75) Inventors: Takuro Hagiwara, Kanagawa (JP); Masaaki Yamaura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 317 days.

(21) Appl. No.: 12/873,603

(22) Filed: Sep. 1, 2010

(65) Prior Publication Data

US 2011/0170897 A1 Jul. 14, 2011

(30) Foreign Application Priority Data

Jan. 13, 2010 (JP) ..... 2010-005276

(51) Int. Cl.
*G03G 21/00* (2006.01)

(52) U.S. Cl.
USPC ..... 399/100; 399/101; 399/357

(58) Field of Classification Search
USPC ..... 399/100, 101, 357; 15/256.5, 256.51, 15/256.52, 256.6
See application file for complete search history.

(56) References Cited

U.S. PATENT DOCUMENTS

| | | | | |
|---|---|---|---|---|
| 3,534,458 | A * | 10/1970 | McCrea | 492/29 |
| 2005/0063728 | A1 * | 3/2005 | Harada et al. | 399/100 |
| 2007/0122179 | A1 * | 5/2007 | Kobayashi et al. | 399/100 |
| 2008/0025753 | A1 * | 1/2008 | Yamamoto et al. | 399/100 |

FOREIGN PATENT DOCUMENTS

| | | |
|---|---|---|
| JP | A-8-137208 | 5/1996 |
| JP | A-2006-276404 | 10/2006 |

* cited by examiner

*Primary Examiner* — Sophia S Chen
(74) *Attorney, Agent, or Firm* — Oliff & Berridge, PLC

(57) ABSTRACT

The present invention provides a cleaning member for an image forming apparatus, including: an axle; and a belt-like elastic medium that is wound on the outer circumferential surface of the axle in a spiral shape and that includes a first edge portion in at least one of both ends in the width direction thereof and a second edge portion coming in contact with a surface to be cleaned at an angle different from that of the first edge portion.

12 Claims, 12 Drawing Sheets

CLEANING MEMBER FOR IMAGE FORMING APPARATUS, CHARGING DEVICE, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2010-005276 filed Jan. 13, 2010.

BACKGROUND

1. Technical Field

The present invention relates to a cleaning member for an image forming apparatus, a charging device, a process cartridge, and an image forming apparatus.

2. Related Art

A cleaning roll including an elastic layer arranged in a spiral shape, which is mounted in an image forming apparatus, has been proposed.

SUMMARY

According to an aspect of the invention, a cleaning member for an image forming apparatus, including: an axle; and a belt-like elastic medium that is wound on the outer circumferential surface of the axle in a spiral shape and that includes a first edge portion in at least one of both ends in the width direction thereof and a second edge portion coming in contact with a surface to be cleaned at an angle different from that of the first edge portion, is provided.

BRIEF DESCRIPTION OF THE DRAWINGS

Exemplary embodiments of the invention will be described in detail based on the following figures, wherein.

DETAILED DESCRIPTION

Figure 1:
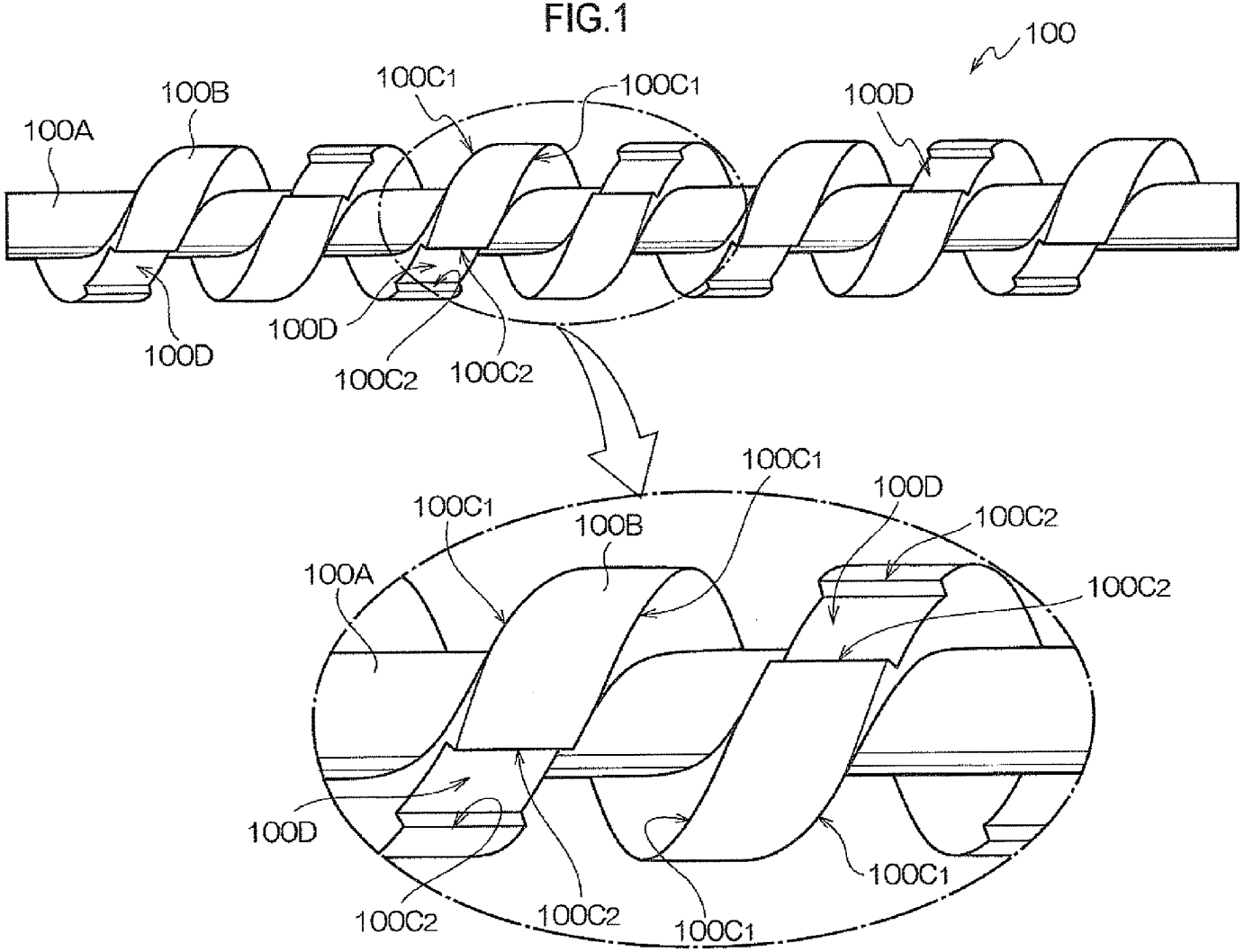
FIG. 1 is a schematic plane view illustrating a cleaning member for an image forming apparatus according to an exemplary embodiment of the invention.

Exemplary embodiments according to the aspect of the invention include, but are not limited to the following items <1> to <11>.

<1> A cleaning member for an image forming apparatus, including: an axle; and a belt-like elastic medium that is wound on the outer circumferential surface of the axle in a spiral shape and that includes a first edge portion in at least one of both ends in the width direction thereof and a second edge portion coming in contact with a surface to be cleaned at an angle different from that of the first edge portion.

<2> The cleaning member for an image forming apparatus according to the item <1>, further including a concave portion in the surface of the elastic medium, wherein the second edge portion is formed by a boundary portion of the surface of the elastic medium and the concave portion.

<3> The cleaning member for an image forming apparatus according to the item <2>, wherein a plurality of the concave portions are arranged in a spiral direction of the elastic medium with an interval therebetween, and wherein the plural concave portions are arranged so that at least a part of the surface of the elastic medium is in contact with the surface to be cleaned in the axis direction of the axle during a turn of the cleaning member.

<4> The cleaning member for an image forming apparatus according to the item <2> or the item <3>, wherein the boundary portion forming the second edge portion is curved or bent from one end to the other end in the width direction of the elastic medium.

<5> The cleaning member for an image forming apparatus according to any one of the items <1> to <4>, wherein a spiral angle θ of the elastic medium is in a range of from about 10° to about 65°.

<6> The cleaning member for an image forming apparatus according to any one of the items <1> to <5>, wherein a spiral width R1 of the elastic medium is in a range of from about 3 mm to about 25 mm.

<7> The cleaning member for an image forming apparatus according to any one of the items <1> to <6>, wherein the elastic medium comprises foamed resin of polyurethane.

<8> A charging device including: a charging member that charges a medium to be charged; and the cleaning member for an image forming apparatus according to any one of the items <1> to <7> as a cleaning member that is disposed to come in contact with the surface of the charging member so as to clean the surface of the charging member.

<9> A process cartridge including the charging device according to the item <8> and capable of being detachably mounted on an image forming apparatus.

<10> An image forming apparatus including: a photoreceptor; a charging unit that charges the surface of the photoreceptor and that includes the charging device according to the item <8>; a latent image forming unit that forms a latent image on the charged surface of the photoreceptor; a developing unit that develops the latent image formed on the photoreceptor into a toner image by the use of a toner; and a transfer unit that transfers the toner image onto a transfer medium.

Hereinafter, exemplary embodiments of the invention will be described. In the figures, members having the same functions and operations are referenced by the same reference numerals and signs and description thereof may not be repeated.

Cleaning Member

Figure 2:
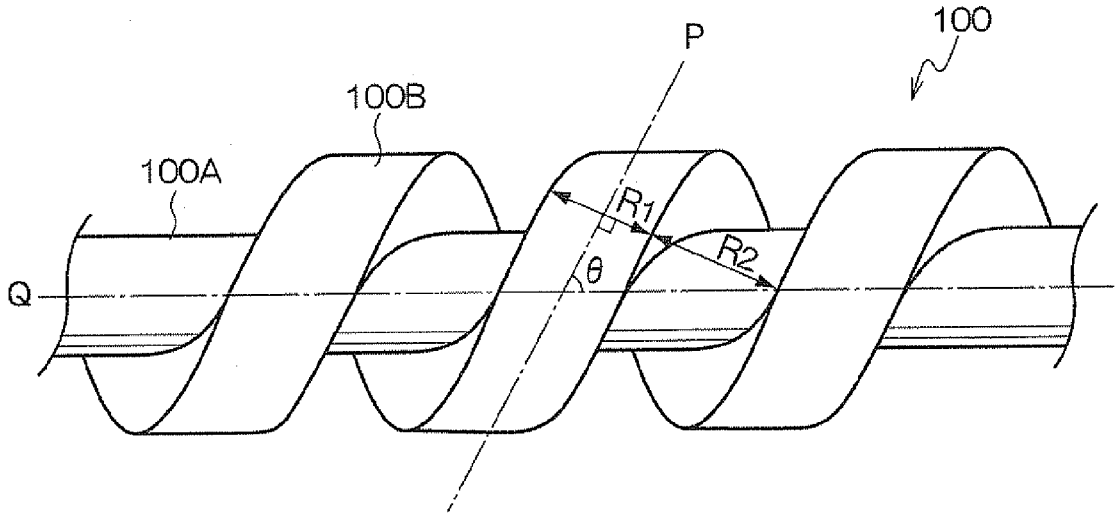
FIG. 2 is an enlarged plane view illustrating an elastic layer of the cleaning member for an image forming apparatus according to the exemplary embodiment of the invention.

FIG. 1 is a schematic plane view illustrating a cleaning member for an image forming apparatus according to an exemplary embodiment of the invention. FIG. 2 is an enlarged plane view illustrating an elastic layer of the cleaning member for an image forming apparatus according to the exemplary embodiment of the invention.

The cleaning member 100 for an image forming apparatus (hereinafter, simply referred to as "cleaning member") according to this exemplary embodiment is a roll-like member including a shaft 100A as an axle and an elastic layer 100B as a belt-like elastic medium, as shown in FIG. 1. The elastic layer 100B is wound in a spiral shape on the surface of the shaft 100A. Specifically, the elastic layer 100B is wound in a spiral shape with an interval from one end of the shaft 100A to the other end using the axis of the shaft 100A as a spiral axis.

The elastic layer 100B disposed in a spiral shape includes first edge portions 100$C_1$ located at both ends in the width direction (hereinafter, referred to as "spiral width direction") thereof and a second edge portion 100$C_2$ coming in contact with a surface to be cleaned at an angle different from that of the first edge portion 100$C_1$.

Here, the angle at which each edge portion comes in contact with the surface to be cleaned means an angle at which the edge portion and the axis direction of the shaft 100A intersect each other on the surface to be cleaned. That is, if the angles of the first edge portion 100$C_1$ and the second edge portion 100$C_2$ coming in contact with the surface to be cleaned are different from each other, it means that the angles at which the edge portions intersect the axis direction of the shaft 100A are different from each other.

The first edge portion 100$C_1$ may be disposed in at least one of both ends of the spiral width direction.

The first edge portion 100$C_1$ is a portion formed by the side surfaces of the elastic layer 100B (surfaces opposed to each other in the spiral width direction) and the surface of the elastic layer 100B (a surface facing the outer circumferential surface of the cleaning member 100) and is a portion arranged in a direction (hereinafter, referred to as "spiral direction") in which the elastic layer 100B is wound on the shaft 100A.

A concave portion 100D with a depth of, for example, from 10% to 90% with respect to the thickness of the elastic layer 100B and a length (a length in the spiral direction of the elastic layer 100B) of, for example, from 1 mm to 100 mm is formed, for example, in the surface of the elastic layer 100B (the surface facing the outer circumferential surface of the cleaning member 100), and the second edge portion 100$C_2$ is formed by a boundary portion (that is, a stepped portion) of the concave portion 100D and the surface (an area in which the concave portion is not formed) of the elastic layer 100B. Plural concave portions 100D forming the second edge portion 100$C_2$ are arranged in the spiral direction of the elastic layer 100B with an interval. The concave portions 100D are disposed to partition the surface of the elastic layer 100B all over the area in the spiral width direction of the elastic layer 100B.

The second edge portion 100$C_2$ is a portion formed by the surface of the elastic layer (the surface facing the outer circumferential surface of the cleaning member 100, that is, the surface coming in contact with the surface to be cleaned) and the wall surfaces (wall surfaces opposed to each other in the spiral direction of the elastic layer 100B) of the concave portion 100D and are arranged from one end to the other end in the spiral width direction of the elastic layer 100B. In this exemplary embodiment, the second edge portion 100$C_2$ (the boundary portion) is disposed to extend in a straight line shape from one end to the other end in the spiral width direction of the elastic layer 100B.

The concave portion 100D has a configuration in which the boundary portion with the surface of the elastic layer 100B (the area in which no concave portion is formed) extends in the spiral width direction of the elastic layer 100B, but the invention is not limited to this configuration. The boundary portion may be disposed to extend in the direction intersecting the spiral direction of the elastic layer 100B.

The plural concave portions 100D forming the second edge portion 100$C_2$ are disposed so that at least a part of the elastic layer 100B in the axis direction of the shaft 100A comes in contact with the surface to be cleaned during a turn of the cleaning member 100. An area which does not come in contact with the surface to be cleaned due to the concave portion 100D exists in the elastic layer 100B having the concave portion 100D formed therein. However, when plural concave portions 100D are formed, only an area having the concave portions 100D may exist in a virtual line along the axis direction of the shaft 100A depending on the interval thereof and a place in which the elastic layer 100B does not come in contact with the surface to be cleaned due to the concave portions 100D may exist in a part of the cleaning member 100 in the axis direction thereof.

Accordingly, when the plural concave portions 100D are formed, the plural concave portions 100D are preferably disposed so that the area in which the elastic layer 100B does not come in contact with the surface to be cleaned due to the plural concave portions 100D does not exist in the axis direction of the shaft 100A during a turn of the cleaning member 100.

To realize this configuration, when the cleaning member 100 is formed by cutting a sheet-like elastic layer forming member (foamed polyurethane sheet or the like) to obtain a strip 100E and winding the strip on the shaft 100A to form the elastic layer 100B (see FIGS. 3A, 3B and 3C), for example, a method of forming the concave portions 100D in the strip 100E (elastic layer 100B) so that the pitch A (the total length in the longitudinal direction of an area in which no concave portion is formed and an area in which a concave portion is formed) of the concave portions 100D disposed in the strip 100E is different from the circumferential length of the shaft 100A may be used.

Accordingly, at least a part of the elastic layer 100B in the axis direction of the shaft 100A is always kept in contact with the surface to be cleaned during a turn of the cleaning member 100.

The constituent elements will be described in detail.

First, the shaft will be described.

Examples of the material of the shaft 100A include metal (such as free-cutting steel or stainless steel) or resin (such as polyacetal resin (POM)). The material or the surface processing method may be preferably selected as needed.

Particularly, when the shaft 100A is formed of metal, a plating process is preferably performed. When the shaft is formed of a material such as resin not having conductivity, it may be subjected to a general process such as the plating process to become conductive, or may be used without any change.

The elastic layer will be described below.

The elastic layer 100B is arranged in a spiral shape. Specifically, for example, the spiral angle θ of the elastic member is preferably in the range of from 10° or about 10° to 65° or about 65° and the spiral width R1 of the elastic member is in a range of from 3 mm or about 3 mm to 25 mm or about 25 mm. The spiral pitch R2 of the elastic member is preferably in the range of from 1 mm to 100 mm.

Here, as shown in FIG. 2, the spiral angle θ means an angle (acute angle) at which the length direction P (spiral direction) of the elastic layer 100B and the axis direction Q (shaft axis direction) of the cleaning member intersect each other.

The spiral width R1 means a length in the direction perpendicular to the length direction P (spiral direction) of the elastic layer 100B.

The spiral pitch R2 means a distance between the neighboring elastic layers 100B in the direction perpendicular to the length direction P (spiral direction) of the elastic layer 100B.

The elastic layer 100B means a layer formed of a material that is restored to an original form even when it is deformed with an application of an external force of 100 Pa.

Examples of the material of the elastic layer 100B include foamed resins such as polyurethane, polyethylene, polyamide, or polypropylene and materials obtained by blending one or two or more species of rubber materials such as silicon rubber, fluorine rubber, urethane rubber, ethylene-propylene-diene compolyer rubber (EPDM, acrylonitrilie-butadiene copolymer rubber (NBR), chloroprene rubber (CR), chlorinated polyisoprene rubber, isoprene rubber, acyrlonitrile-butadiene rubber, styrene-butadiene rubber, hydrogenerated polybutadiene rubber, or butyl rubber. Auxiliary agents such as foaming agent, foam stabilizer, catalyst, curing agent, plasticizer, or vulcanization accelerator may be added to the materials as needed.

Among these, materials (so-called foams) having bubbles are preferable and foamed polyurethane resistant to a tension is more preferable from the viewpoint that the surface of a cleaning target should not damaged due to friction and cut or break should not be caused over long term.

Examples of polyurethane include reaction products of polyol (such as polyester polyol, polyether polyester, or acrylpolyol) and isocyanate (such as 2,4-toluene diisocyanate, 2,6-toluene diisocyanate, 4,4'-diphenylmethane diisocyanate, tolidine diisocyanate, or 1,6-hexamethylene diisocyanate) and may include a chain extender (such as 1,4-butane diol or trimethylolpropane). The foaming of polyurethane is generally performed using a foaming agent such as water or azo compound (such as azodicarbonamide or azobisisobutyronitrile). The auxiliary agents such as foaming agent, foam stabilizer, or catalyst may be added to the foamed polyurethane as needed.

The elastic layer 100B may have a single-layered structure or a laminated structure. Specifically, the elastic layer 100B may have a structure including only one foam layer or may have a two-layered structure including a solid layer and a foamed layer.

A method of manufacturing the cleaning member 100 according to this exemplary embodiment will be described below.

Examples of the method of manufacturing the cleaning member 100 according to this exemplary embodiment include the followings.

(1) A method of obtaining the cleaning member 100, by preparing an elastic-layer material (such as foamed polyurethane) shaped into a rectangular column, forming a hole into which the shaft 100A is inserted in the elastic-layer material by using a drill or the like, inserting the shaft 100A of which the outer circumferential surface is coated with an adhesive agent into the hole of the elastic-layer material, performing a cutting work on the elastic-layer member to form the elastic layer 100B, and forming concave portions 100D in the elastic layer 100B.

(2) A method of obtaining the cleaning member 100, by preparing an elastic-layer material (such as foamed polyurethane) which becomes the elastic layer 100B having the concave portions 100D later by using a mold, forming a hole into which the shaft 100A is inserted in the elastic-layer material by using a drill or the like, and inserting the shaft 100A of which the outer circumferential surface is coated with an adhesive agent into the hole of the elastic-layer material.

(3) A method of obtaining the cleaning member 100, by preparing a sheet-like elastic-layer material (such as a foamed polyurethane sheet) in which the concave portions 100D are formed in advance, attaching a double-sided tape thereto, punching the resultant to obtain a strip, and winding the strip on the shaft 100A to form the elastic layer 100B having the concave portions 100D.

Among these, the method of obtaining the cleaning member by winding the strip on the shaft to form the elastic layer 100B is simple and preferable.

Figure 3A:
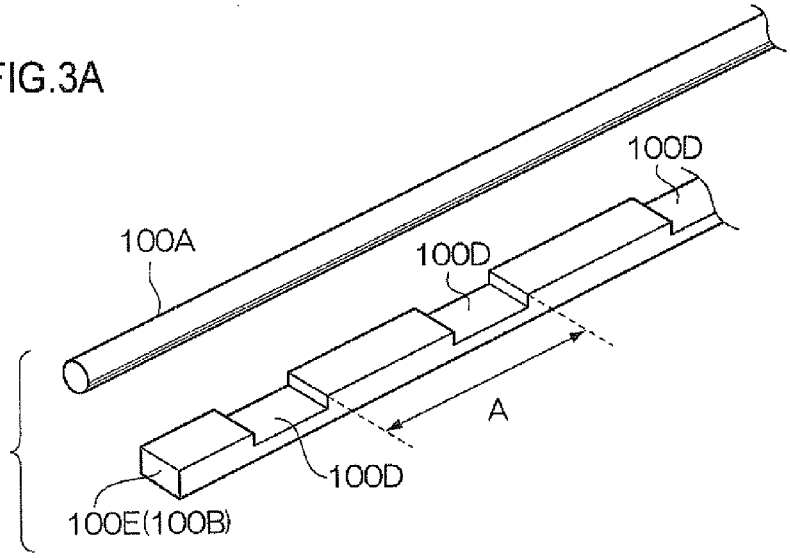
FIGS. 3A, 3B and 3C are diagrams illustrating process steps of a method of manufacturing the cleaning member for an image forming apparatus according to the exemplary embodiment of the invention.

This method will be described in more detail. First, as shown in FIG. 3A, a sheet-like elastic-layer material (such as a foamed polyurethane sheet) having been subjected to a slicing process to have a target thickness is prepared and grooves which become the concave portions 100D are formed in the sheet-like elastic-layer material. A double-sided tape (not shown) is attached to one surface of the sheet-like elastic-layer material and the material is punched by the use of a punch die to obtain a strip 100E (strip having a double-sided tape attached thereto) with target width and length. Of course, the grooves which become the concave portions 100D may be formed after obtaining the strip 100E. On the other hand, the shaft 100A is also prepared.

Figure 3B:
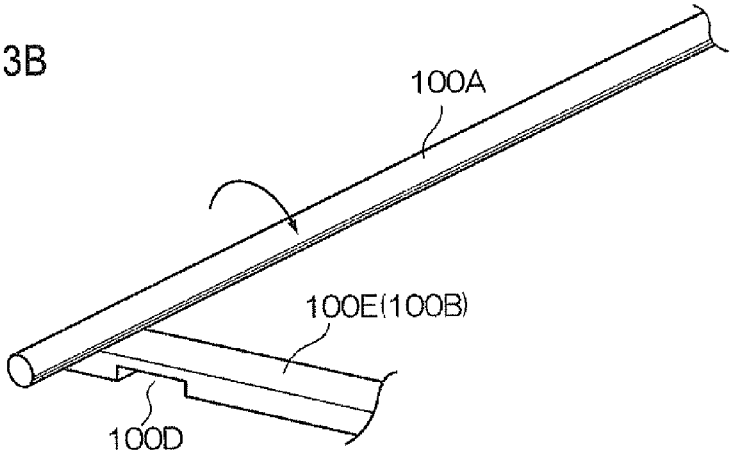

Then, as shown in FIG. 3B, the strip 100E is disposed so that the surface having the double-side tape attached thereto is directed to the upside, one end of a release paper of the double-sided tape is detached therefrom in this state, and an end portion of the shaft 100A is placed on the double-sided tape from which the release paper is detached.

Figure 3C:
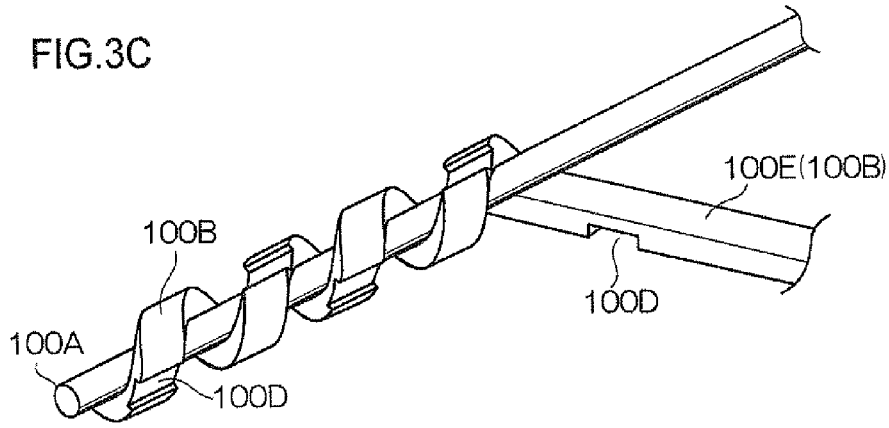

As shown in FIG. 3C, the shaft 100A is rotated at a predetermined speed while detaching the release paper from the double-sided tape, whereby the strip 100E is wound in a spiral shape on the outer circumferential surface of the shaft 100A. Finally, the cleaning member 100 having the elastic layer 100B arranged in a spiral shape on the outer circumferential surface of the shaft 100A is obtained.

In the above-described cleaning member 100 according to this exemplary embodiment, the elastic layer 100B arranged in a spiral shape repeatedly comes in contact with and gets separated from the surface (surface to be cleaned) of a cleaning target with the rotation, and the first edge portions 100$C_1$ at both ends in the spiral width direction of the elastic layer 100B apply a force in the axis direction of the shaft 100A with respect to the surface (surface to be cleaned) of the cleaning target to perform the cleaning.

At this time, the first edge portions 100$C_1$ at both ends in the spiral width direction of the elastic layer 100B come in contact with the surface to be cleaned at an angle (see FIG. 4A) to perform the cleaning with the rotation of the cleaning member 100.

Figure 4A:
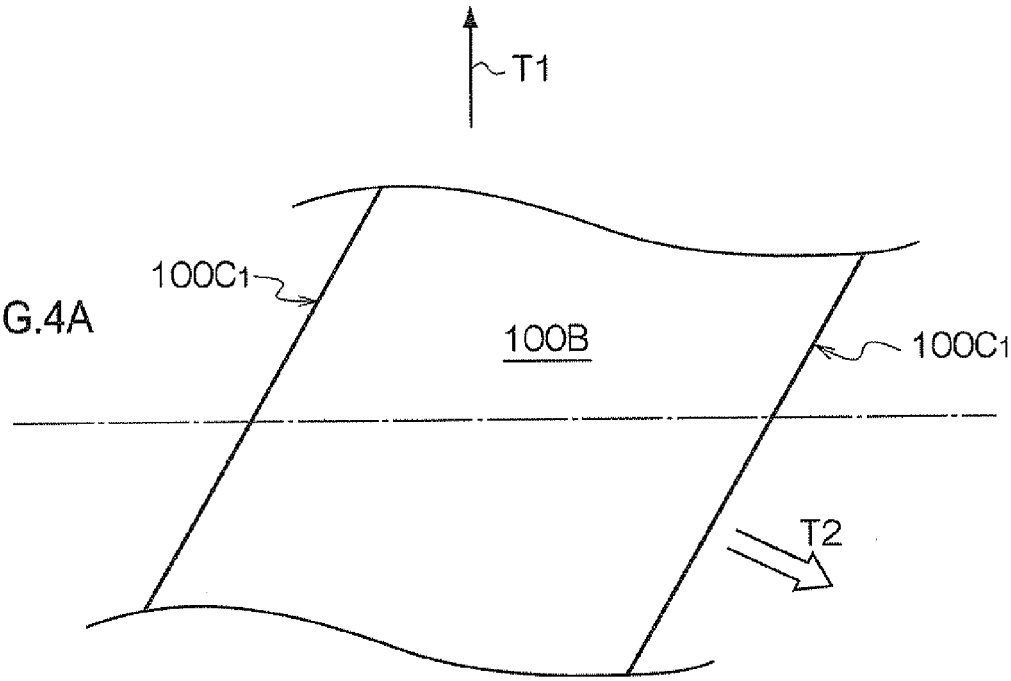
FIGS. 4A and 4B are schematic diagrams illustrating an operation of the cleaning member for an image forming apparatus according to the exemplary embodiment of the invention.
Figure 4B:
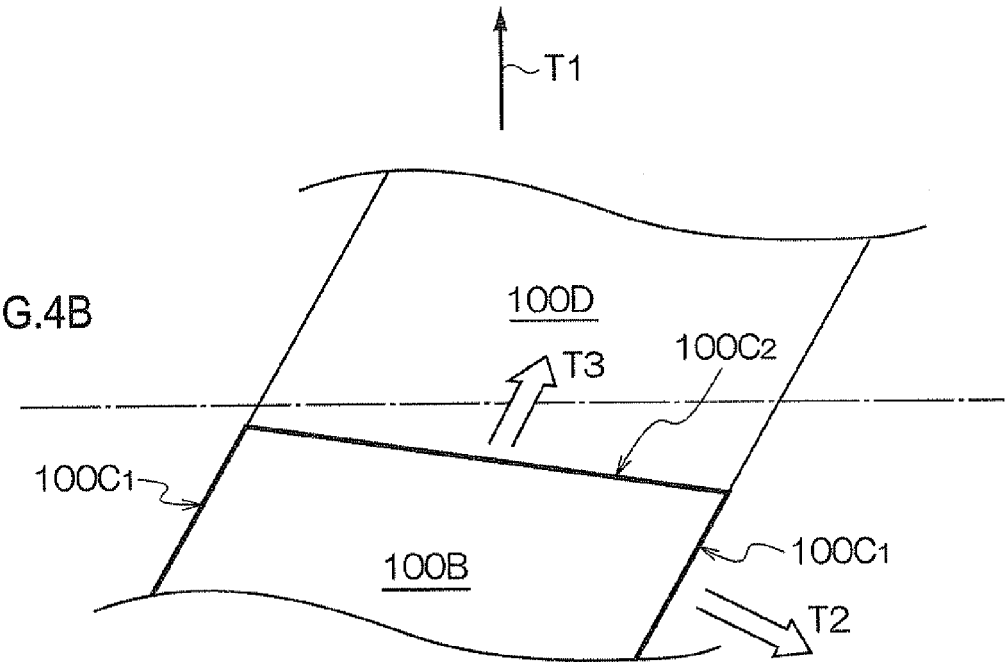

When the second edge portions 100$C_2$ comes in contact with the surface to be cleaned with the rotation of the cleaning member 100, the second edge portions 100$C_2$ come in contact with the surface to be cleaned at an angle different from that of the first edge portions 100$C_1$ (FIG. 4B).

Accordingly, by providing the second edge portions 100$C_2$, a force is applied to the surface to be cleaned in a direction different from that of the first edge portions 100$C_1$ by the second edge portions 100$C_2$. That is, the forces in more directions are applied to the surface to be cleaned, compared with the case where only the first edge portions 100$C_1$ comes in contact with the surface to be cleaned.

FIGS. 4A and 4B schematically show the contact portion of the cleaning member 100 (the elastic layer 100B thereof) with the surface to be cleaned. In FIGS. 4A and 4B, arrow T1 represents the rotation direction of the cleaning member 100, arrow T2 represents the direction in which the force is applied to the surface to be cleaned by the first edge portions 100$C_1$, and arrow T3 represents the direction in which the force is applied to the surface to be cleaned by the second edge portions 100$C_2$.

In the cleaning member 100 according to this exemplary embodiment, since the concave portions 100D are formed in the elastic layer 100B and the second edge portions are formed by the boundary portions of the surface of the elastic layer 100B and the concave portions 100D, the burial of the material removed from the surface to be cleaned into the elastic layer 100B is suppressed, compared with the case where the second edge portions 100$C_2$ are formed by slits (notches) formed in the surface of the elastic layer 100B.

In the cleaning member 100 according to this exemplary embodiment, by providing plural concave portions 100D forming the second edge portions 100$C_2$ so that at least a part of the elastic layer 100B is in contact with the surface to be cleaned during a turn of the cleaning member 100, at least a part of the elastic layer 100B in the axis direction of the shaft 100A is always maintained in contact with the surface to be cleaned during the turn of the cleaning member 100, whereby the idle rotation of the cleaning member 100 is suppressed.

Figure 5:
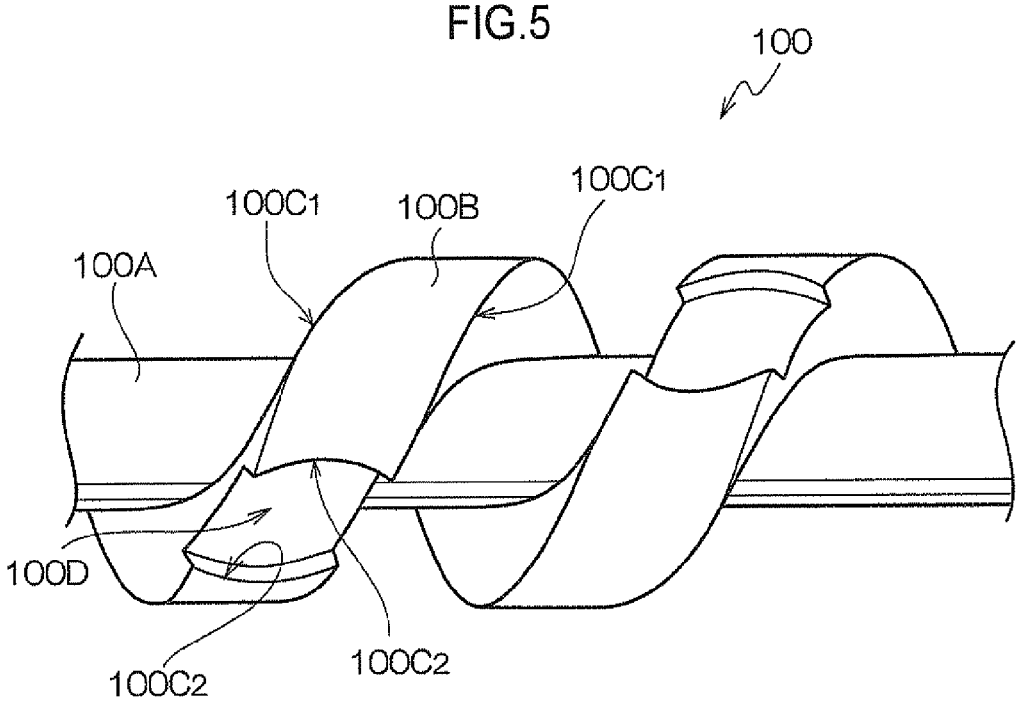
FIG. 5 is an enlarged plane view illustrating an elastic layer of a cleaning member for an image forming apparatus according to another exemplary embodiment of the invention.
Figure 6:
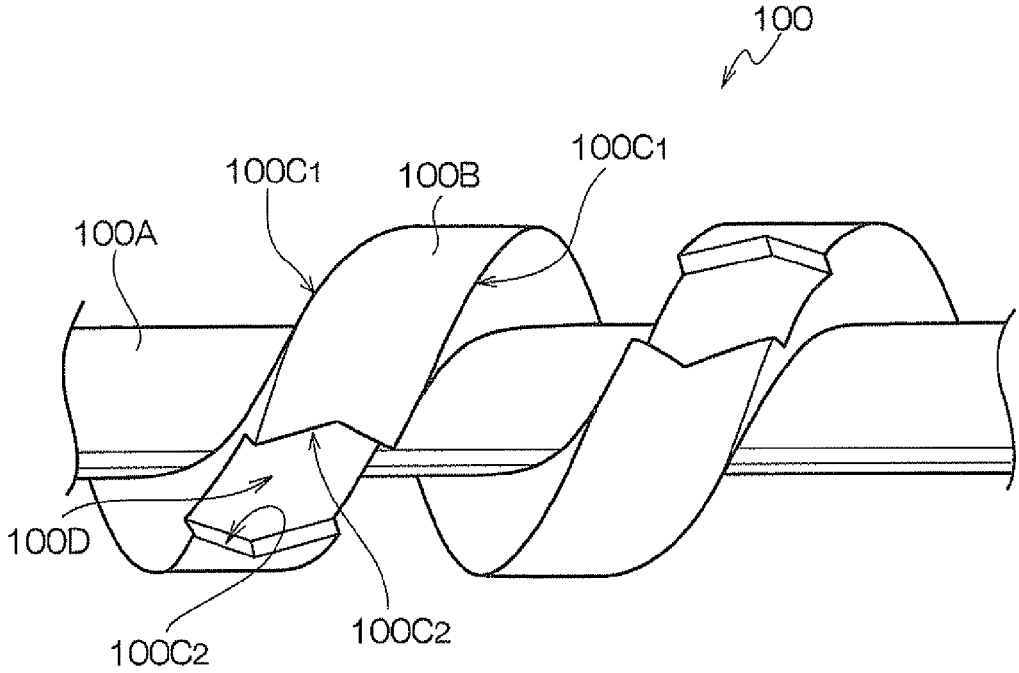
FIG. 6 is an enlarged plane view illustrating an elastic layer of a cleaning member for an image forming apparatus according to another exemplary embodiment of the invention.

In the cleaning member 100 according to this exemplary embodiment, each concave portion 100D forming the second edge portion has a rectangular plane shape (as viewed in the diameter direction of the cleaning member 100), that is, the boundary portion forming the second edge portion 100$C_2$ extends in a straight line from one end in the spiral width direction of the elastic layer 100B to the other end, but the invention is not limited to this configuration. For example, as shown in FIG. 5, the boundary portion forming the second edge portion 100$C_2$ may be curved from one end in the spiral width direction of the elastic layer 100B to the other end. Alternatively, as shown in FIG. 6, the boundary portion forming the second edge portion 100$C_2$ may be bent from one end in the spiral width direction of the elastic layer 100B to the other end.

Specifically, examples of the configuration in which the boundary portion forming the second edge portion 100$C_2$ is curved from one end in the spiral width direction of the elastic layer 100B to the other end include a configuration in which a pair of opposed sides (opposed sides opposed to each other in the spiral direction of the elastic layer 100B) of the rectangle in a plane view of the concave portion 100D are curved to expand to the outside of the concave portion 100D in a circular shape (see FIG. 5) and a configuration in which the opposed sides are curved to cave in to the inside of the concave portion 100D in a circular shape. A curved-wave configuration in which the shape curved to expand to the outside of the concave portion 100D in a circular shape and the shape curved to cave in to the inside of the concave portion 100D in a circular shape are repeatedly arranged may be also used.

On the other hand, examples of the configuration in which the boundary portion forming the second edge portion 100$C_2$ is bent from one end in the spiral width direction of the elastic layer 100B to the other end include a configuration in which a pair of opposed sides (opposed sides opposed to each other in the spiral direction of the elastic layer 100B) of the rectangle in a plane view of the concave portion 100D are bent to protrude to the outside of the concave portion 100D in a triangular shape (see FIG. 6) and a configuration in which the opposed sides are bent to cave in to the inside of the concave portion 100D in a triangular shape. A triangular-wave configuration in which the shape bent to protrude to the outside of the concave portion 100D in a triangular shape and the shape bent to cave in to the inside of the concave portion 100D in a triangular shape are repeated may be also used.

In the configurations in which the boundary portion forming the second edge portion 100$C_2$ is curved or bent from one end in the spiral width direction of the elastic layer 100B to the other end (see FIGS. 5 and 6), the first edge portion 100$C_1$ comes in contact with the surface to be cleaned at an angle (see FIG. 7A), performs the cleaning with the rotation of the cleaning member 100, and the second edge portions 100$C_2$ come in contact with the surface to be cleaned at an angle different from the angle of the first edge portions 100$C_1$ and come in contact with the surface to be cleaned at different angles in the second edge portion 100$C_2$ (see FIG. 7B) when the second edge portions 100$C_2$ come in contact with the surface to be cleaned with the rotation of the cleaning member 100. That is, forces in more directions are applied to the surface to be cleaned, compared with the case where the first edge portions 100$C_1$ and the second edge portions 100$C_2$ of a straight line shape come in contact with the surface to be cleaned.

Figure 7A:
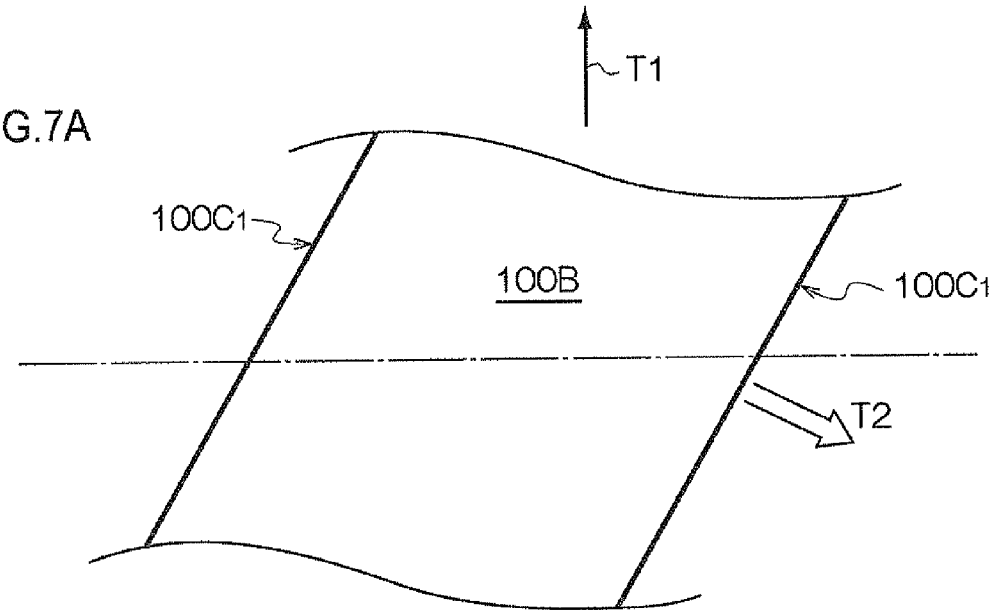
FIGS. 7A and 7B are schematic diagrams illustrating an operation of a cleaning member for an image forming apparatus according to another exemplary embodiment of the invention.
Figure 7B:
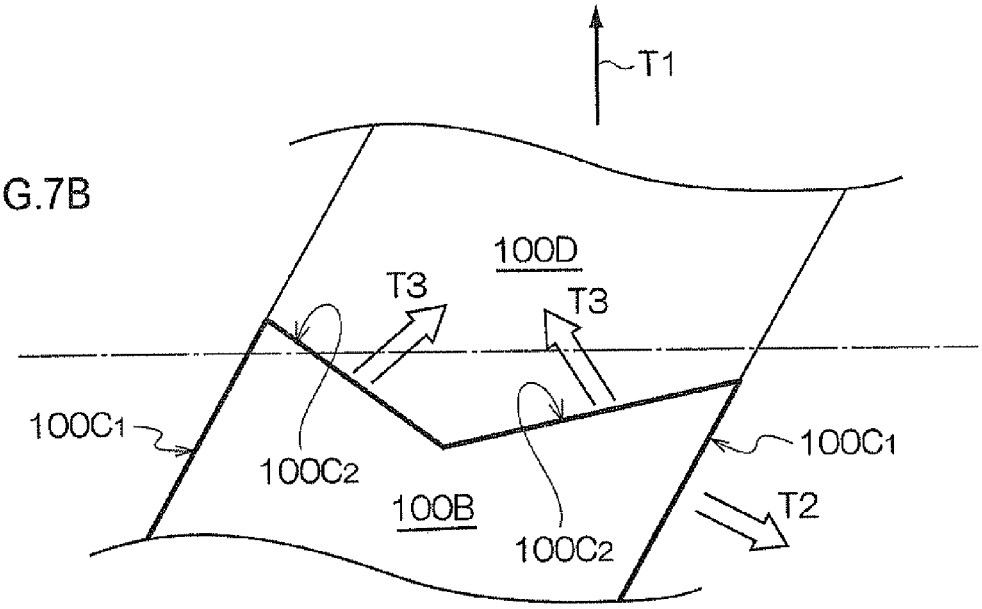

FIGS. 7A and 7B schematically show the contact portion of the cleaning member 100 (the elastic layer 100B thereof) and the surface to be cleaned in the configuration in which the boundary portion forming the second edge portion 100$C_2$ is bent from one end in the spiral width direction of the elastic layer 100B to the other end. In FIGS. 7A and 7B, arrow T1 represents the rotation direction of the cleaning member 100, arrow T2 represents the direction in which the force is applied to the surface to be cleaned by the first edge portion 100$C_1$, and arrow T3 represents the direction in which the force is applied to the surface to be cleaned by the second edge portion 100$C_2$.

Figure 8:
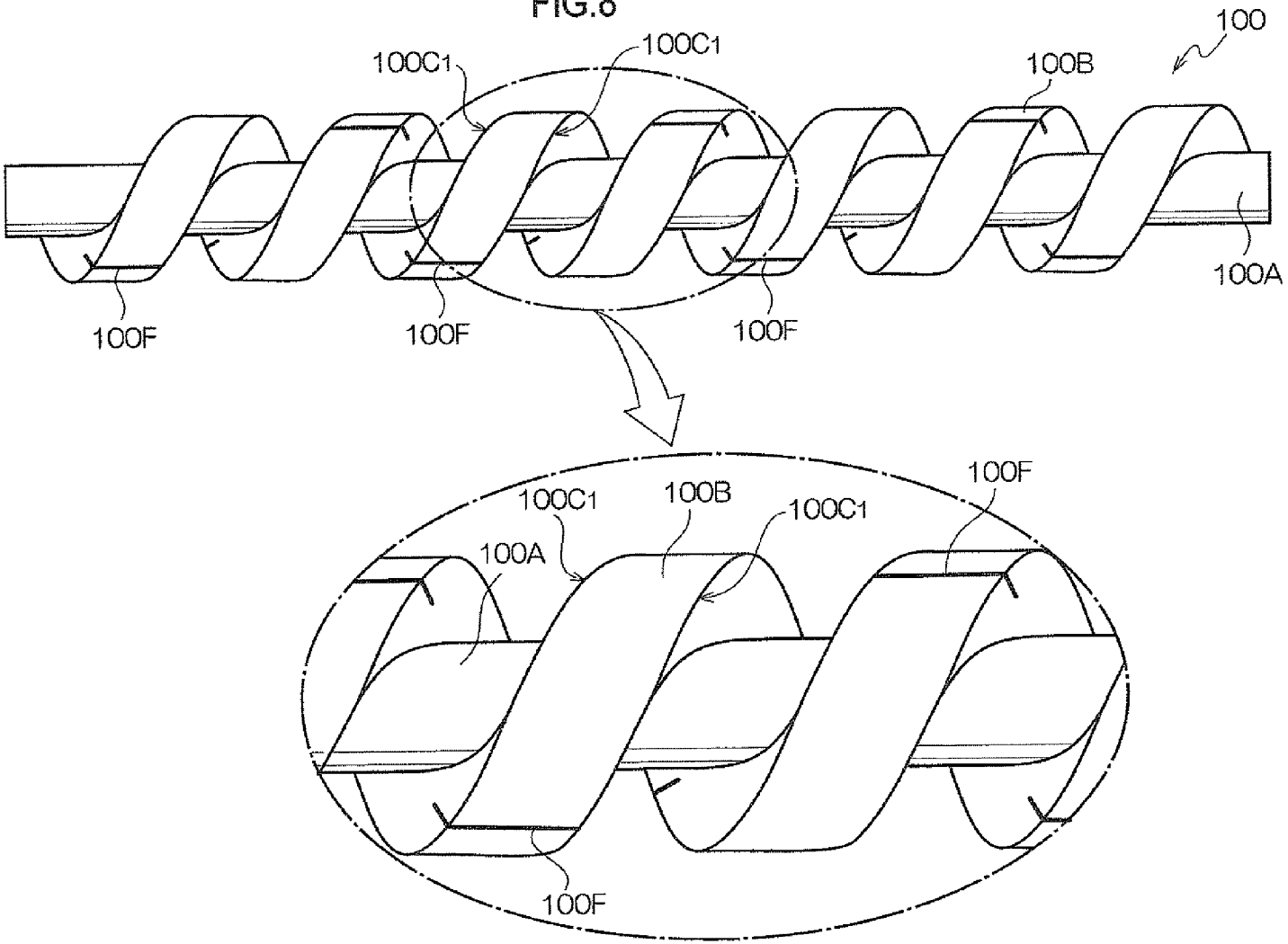
FIG. 8 is a schematic plane view illustrating a cleaning member for an image forming apparatus according to another exemplary embodiment of the invention.

In the cleaning member 100 according to this exemplary embodiment, the concave portions 100D are formed in the elastic layer 100B and the second edge portions are formed by the boundary portions of the surface of the elastic layer 1008 and the concave portions 100D, but the invention is not limited to this configuration. As shown in FIG. 8, slits 100F (notches) in the spiral width direction of the elastic layer 100B may be formed in the surface of the elastic layer 100B and the second edge portions 100$C_2$ may include portions formed by the surface of the elastic layer 100B and the wall surfaces of the elastic layer 100E formed by the slits 100F. The slit 100F is not limited to the configuration in which it is formed in the spiral width direction of the elastic layer 100B, but the slit may be formed in the direction intersecting the spiral direction of the elastic layer 100B.

Figure 9A:
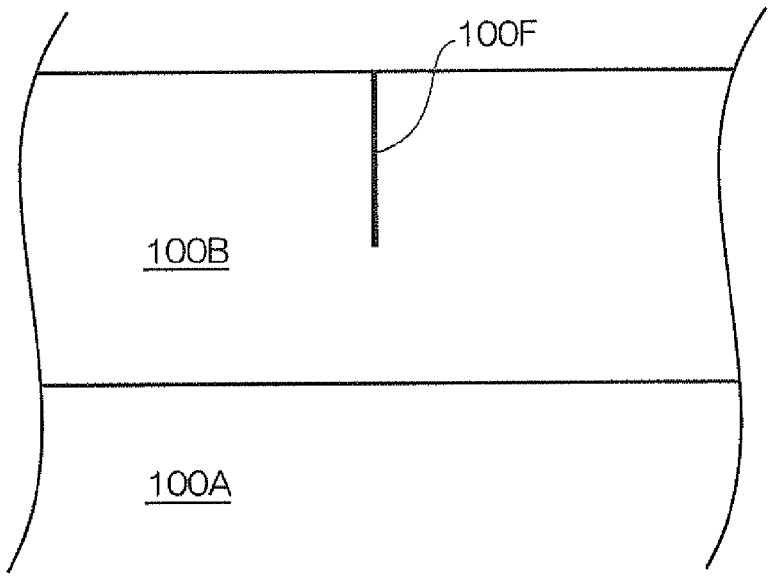
FIGS. 9A and 9B are schematic diagrams illustrating an operation of a cleaning member for an image forming apparatus according to another exemplary embodiment of the invention.
Figure 9B:
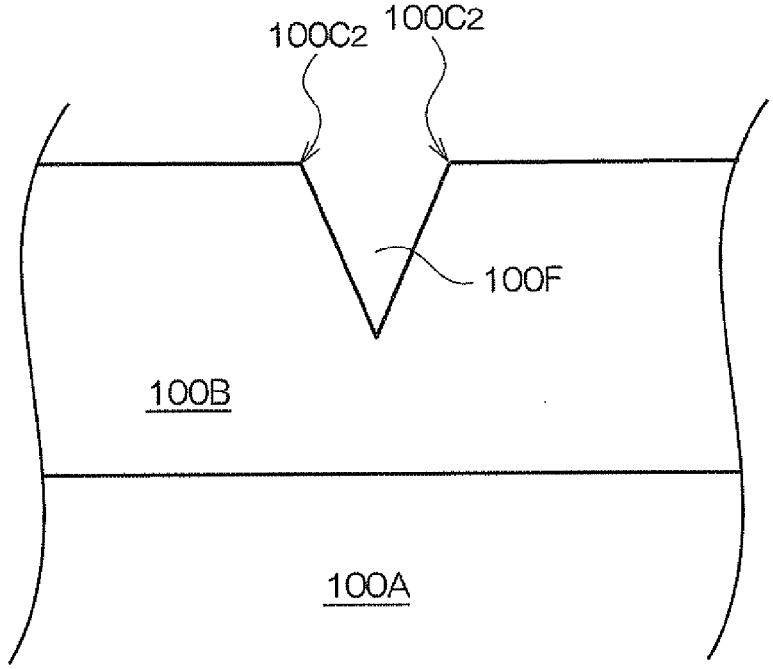

In this exemplary embodiment, when the cleaning member 100 comes in contact with the surface to be cleaned, the elastic layer 100B is elastically deformed from the non-deformed state of the elastic layer 100B (see FIG. 9A), and the slits 100F are also deformed with the deformation, whereby the second edge portions 100$C_2$ come in contact with the surface to be cleaned (see FIG. 9B). The second edge portions 100$C_2$ formed by the slits 100F also come in contact with the surface to be cleaned at an angle different from that of the first edge portions 100$C_1$.

Image Forming Apparatus and Others

The configuration of an image forming apparatus according to this exemplary embodiment will be described below with reference to the accompanying figures.

Figure 10:
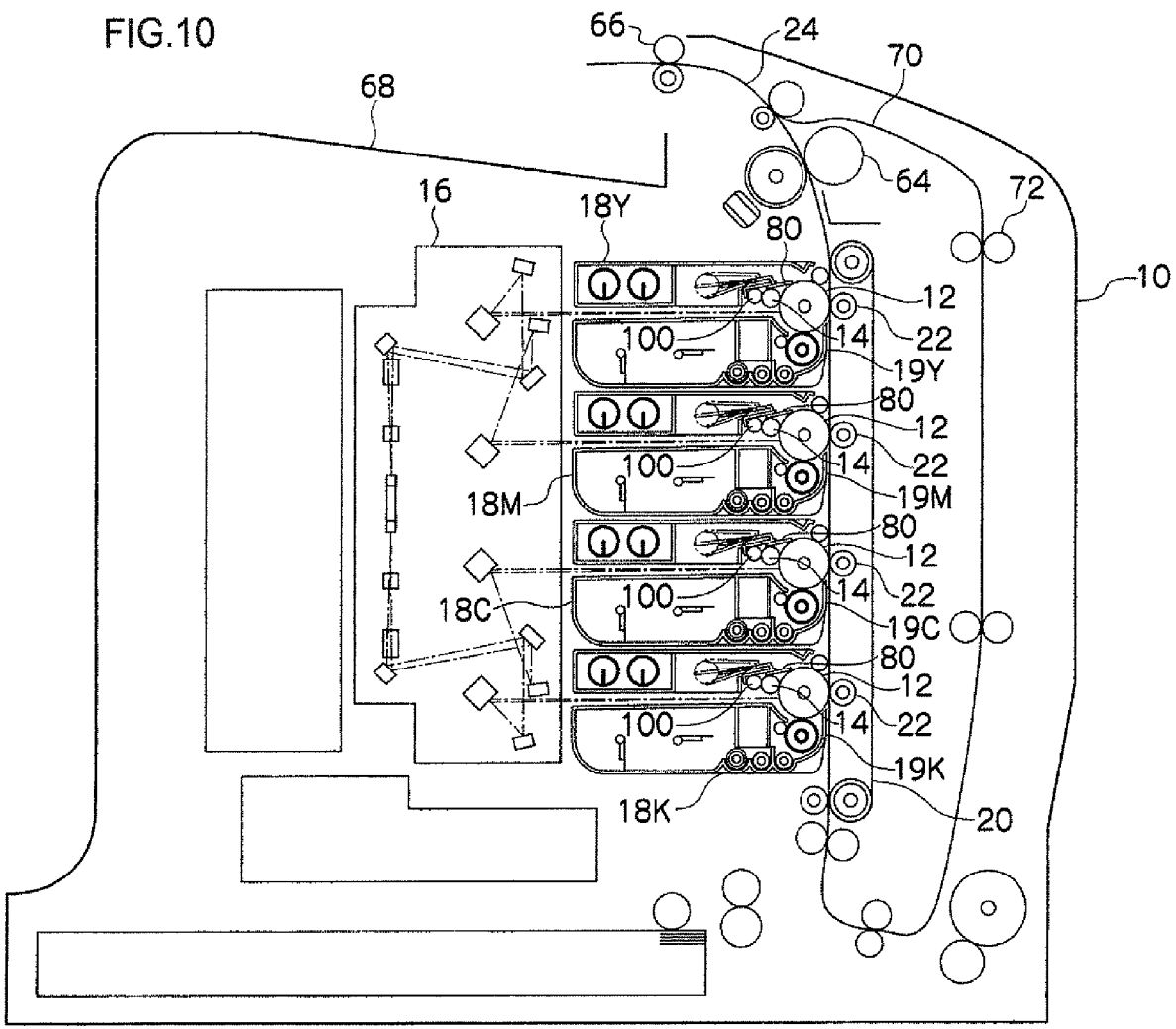
FIG. 10 is a schematic configurational view showing an electrophotographic image forming apparatus according to an exemplary embodiment.

FIG. 10 is a schematic configurational view illustrating the image forming apparatus according to this exemplary embodiment.

Figure 11:
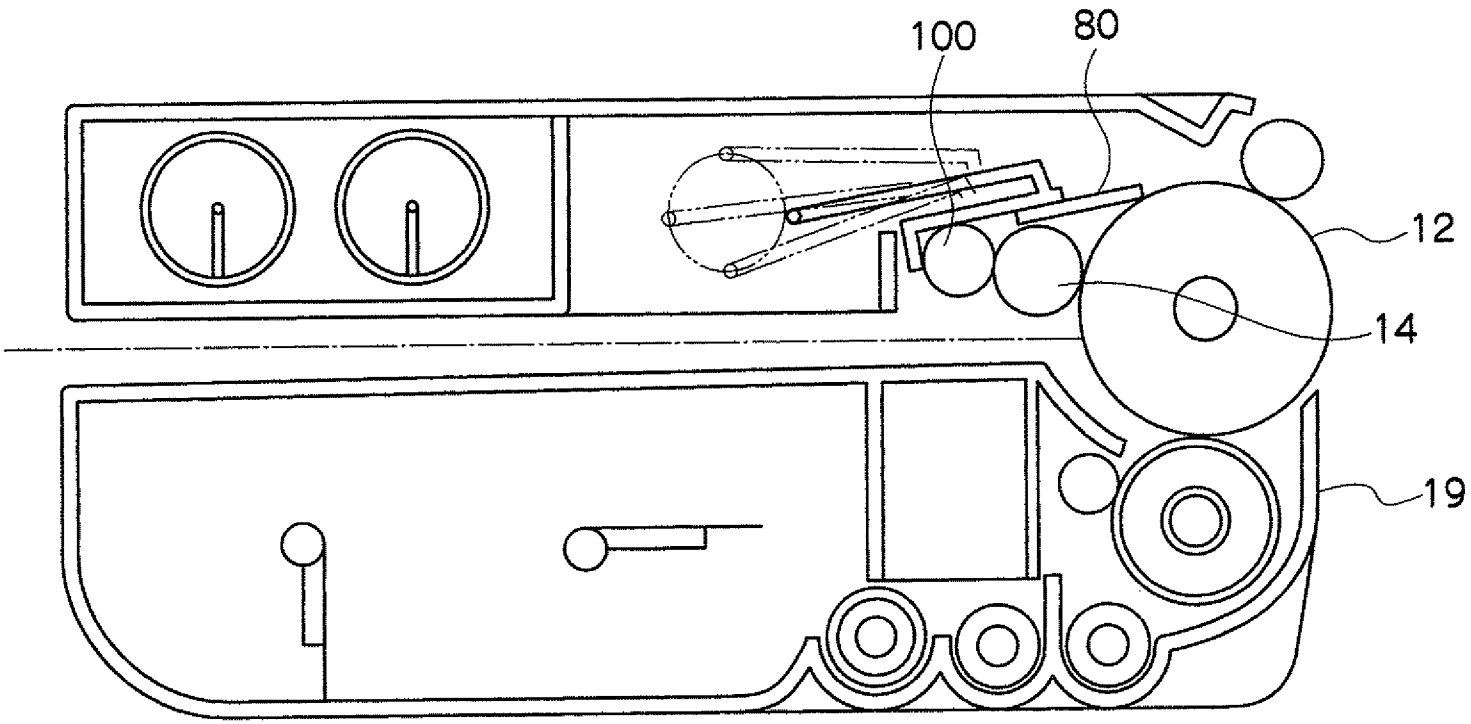
FIG. 11 is a schematic configurational view showing a process cartridge according to an exemplary embodiment.

The image forming apparatus 10 according to this exemplary embodiment is a tandem type color image forming apparatus, for example, as shown in FIG. 10. In the image forming apparatus 10 according to this exemplary embodiment, a photoreceptor (image carrier) 12, a charging member 14, a developing device, and the like are provided as a process cartridge (see FIG. 11) for each color of yellow (18Y), magenta (18M), cyan (18C), and black (18K). The process cartridges can be mounted on and demounted from the image forming apparatus 10.

For example, a conductive cylinder with a diameter of 25 mm having a surface coated with a photosensitive layer formed of an organic sensitive material or the like is used as the photoreceptor 12, and is rotationally driven at a process speed of 150 mm/sec by a motor not shown.

The surface of the photoreceptor 12 is charged by the charging member 14 disposed on the surface of the photoreceptor 12 and is subjected to an image exposure using a laser beam LB emitted from an exposure device 16 at the downstream side of the charging member 14 in the rotation direction of the photoreceptor 12, whereby an electrostatic latent image based on image information is formed thereon.

The electrostatic latent images formed on the photoreceptors 12 are developed by the developing devices 19Y for yellow (Y) color, 19M for magenta (M) color, 19C for cyan (C) color, and 19K for black (K) color respectively, to form toner images of the corresponding colors.

For example, when a color image is formed, the charging, exposing, and developing processes are performed on the surfaces of the photoreceptors 12 of yellow (Y), magenta (M), cyan (C), and black (K) colors, respectively, and thus toner images corresponding to the colors of yellow (Y), magenta (M), cyan (C), and black (K) colors are formed on the surfaces of the photoreceptors 12 by colors, respectively.

The toner images of yellow (Y), magenta (M), cyan (C), and black (K) colors sequentially formed on the photoreceptors 12 are transferred to a recording sheet 24, which is carried to the outer circumferences of the photoreceptors 12 over a sheet carrying belt 20, at positions where the photoreceptors 12 come in contact with the transfer devices 22 via the sheet carrying belt 20 interposed therebetween. The recording sheet 24 onto which the toner images are transferred from the photoreceptors 12 is carried to a fixing device 64 and heated and pressurized by the fixing device 64, whereby the toner images are fixed onto the recording sheet 24. Thereafter, in one-sided printing, the recording sheet 24 onto which the toner image are fixed is discharged to a discharge unit 68 disposed in the upper portion of the image forming apparatus 10 by a discharge roller 66.

On the other hand, in double-sided printing, the recording sheet 24 in which the toner images are fixed onto the first surface (front surface) by the fixing device 64 is not discharged to the discharge unit 68 by the discharge roller 66. Instead, in the state where the trailing edge portion of the recording sheet 24 is nipped by the discharge roller 66, the discharge roller 66 is inverted and the carrying path of the recording sheet 24 is switched to a double-sided sheet carrying path 70, the recording sheet is carried to the sheet carrying belt 20 by a carrying roller 72 disposed in the double-sided sheet carrying path 70 in the state where the front and back of the recording sheet 24 are inverted, and the toner images are transferred onto the second surface (back surface) of the recording sheet 24 from the photoreceptors 12. Then, the toner images on the second surface (back surface) of the recording sheet 24 are fixed by the fixing device 64 and the recording sheet 24 (transfer medium) is discharged to the discharge unit 68.

From the surface of the photoreceptor 12 after the process of transferring the toner image is ended, the remaining toner or paper powders are removed by a cleaning blade 80 disposed, on the surface of the photoreceptor 12, downstream from the contact position with the transfer device 22 in the rotation direction of the photoreceptors 12 every turn of the photoreceptor 12, so as to cope with the next image forming step.

Figure 12:
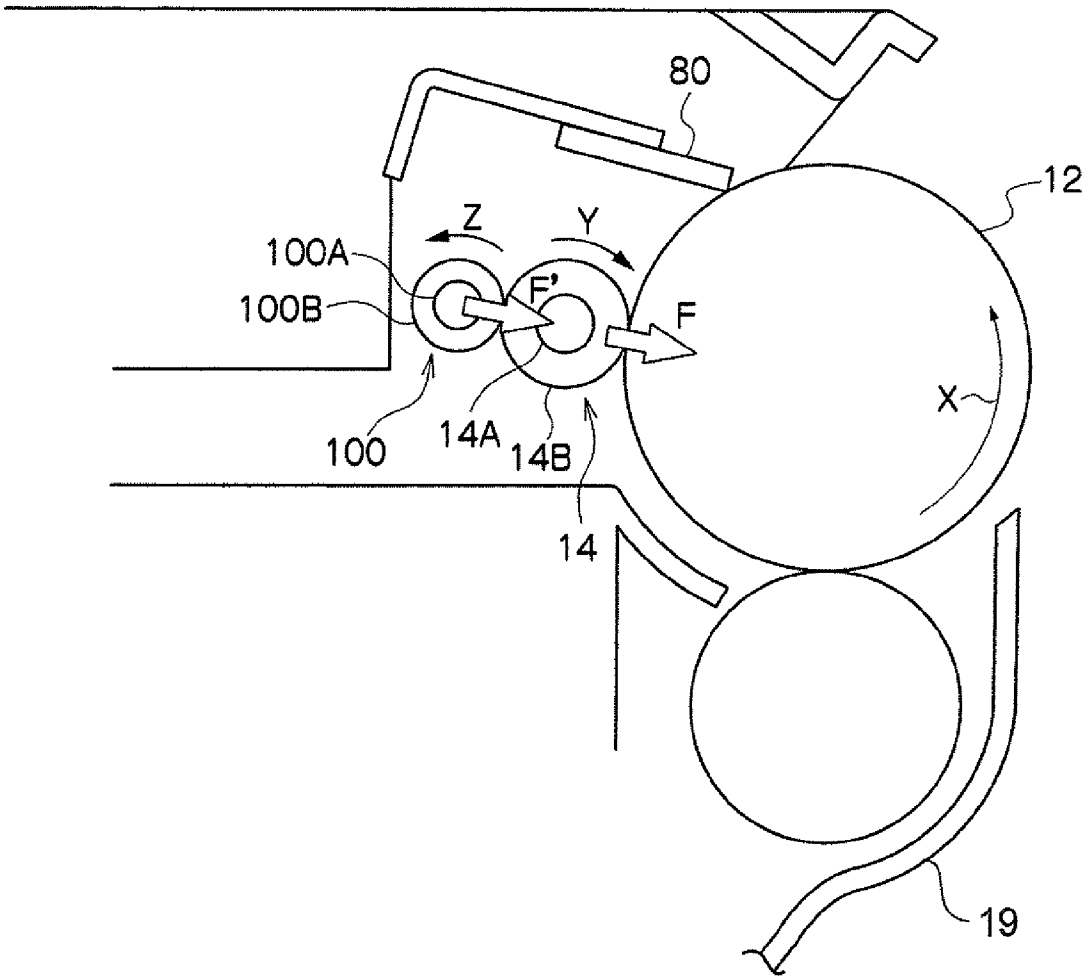
FIG. 12 is an enlarged view schematically illustrating the periphery of a charging member (charging device) in FIGS. 10 and 11.
Figure 13:
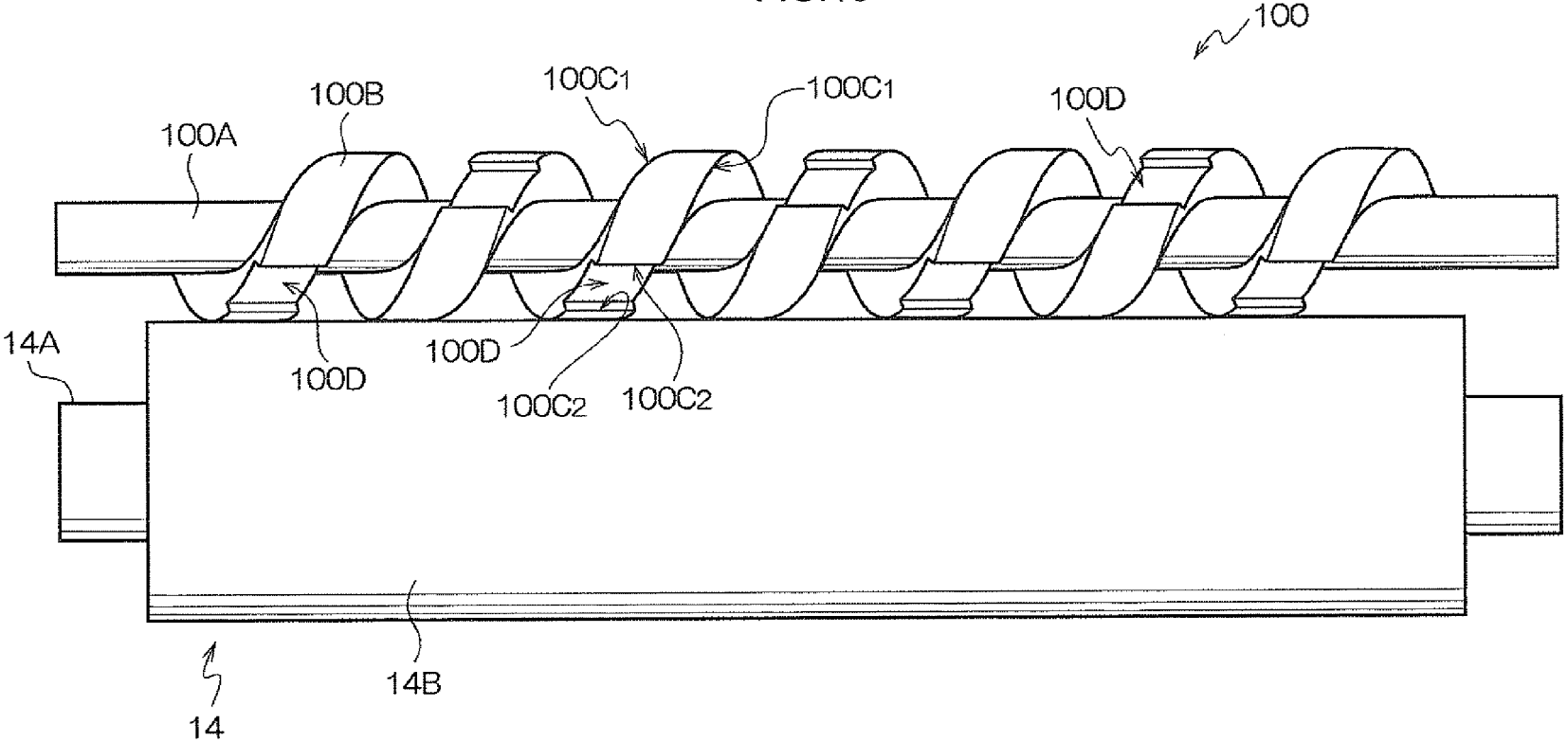
FIG. 13 is a schematic configurational view showing a charging apparatus according to an exemplary embodiment.

Here, as shown in FIGS. 12 and 13, the charging member 14 is, for example, a roller in which an elastic layer 14B is formed around a conductive shaft 14A, and the shaft 14A is rotatably supported. A cleaning member 100 for the charging member 14 comes in contact with the charging member 14 at the opposite side to the photoreceptor 12 to constitute a charging device (unit). The cleaning member 100 according to this exemplary embodiment is used as this cleaning member 100.

The charging member 14 is pressed down against the photoreceptor 12 with a load F to both ends of the shaft 14A and is elastically deformed along the circumferential surface of elastic layer 14B to form a nip portion. The cleaning member 100 is pressed down against the charging member 14 with a load F' to both ends of the shaft 100A and the elastic layer 100B is elastically deformed along the circumferential surface of the charging member 14 to form a nip portion. Accordingly, the warp of the charging member 14 is suppressed to form a nip portion between the charging member 14 and the photoreceptor 12.

The photoreceptor 12 is rotationally driven in the direction of arrow X by a motor not shown and the charging member 14 rotates to follow the rotation of the photoreceptor 12 in the direction of arrow Y. The cleaning member 100 rotates to follow the rotation of the charging member 14 in the direction of arrow Z.

Configuration of Charging Member

The charging member will be described below, but this exemplary embodiment is not limited to the below configuration. Reference numerals and signs will not be described.

The configuration of the charging member is not particularly limited, and an example thereof includes a configuration including a shaft and an elastic layer or a resin layer instead of the elastic layer. The elastic layer may have a single-layered structure or a multi-layered structure including plural different layers having various functions. The elastic layer may be subjected to surface treatment.

Examples of the material of the shaft include free-cutting steel and stainless steel, and the material and the surface processing method may be preferably selected depending on the application. It is preferable to plate the shaft. A material not having conductivity may be processed by a general process such as a plating process to have conductivity, or may be used without being subjected to any process.

The elastic layer may be formed of a conductive elastic layer. For example, the conductive elastic layer includes an elastic material such as rubber having elasticity and a conductive agent such as carbon black or an ion conductive agent for adjusting the resistance of the conductive elastic layer, and a material, which can be typically added to rubber, such as a softening agent, a plasticizer, a curing agent, a vulcanizing agent, a vulcanization accelerator, an anti-aging agent, or a filler of silica or calcium carbonate as needed may be added to the conductive elastic layer. The circumferential surface of the conductive shaft is coated with a mixture containing the material which can be typically added to rubber. An agent in which a conductive material, using one of electrons or ions as charge carriers, such as carbon black or an ion conductive agent blended into a matrix material is dispersed is used as the conductive agent for adjusting the resistance. The elastic material may be foam.

The elastic material forming the conductive elastic layer is formed, for example, by dispersing a conductive agent in a rubber material. Examples of the rubber material include silicon rubber, ethylene propylene rubber, epichlorohydrin-ethyleneoxide copolymer rubber, epichlorohydrin-ethyleneoxide-allylglycidylether copolymer rubber, acrylonitrile-butadiene copolymer rubber, and blended rubber thereof. The rubber material may be foamed or non-foamed.

As the conductive agent, an electronic conductive agent and an ionic conductive agent are used. Examples of the electronic conductive agent include fine powders of, for example, carbon black such as Ketjen black or acetylene black; pyrolyzed carbon, graphite; various kinds of conductive metals or alloys such as aluminum, copper, nickel, or stainless steel; various kinds of conductive metal oxides such as tin oxide, indium oxide, titanium oxide, tin oxide-antimony oxide solid solution, or tin oxide-indium oxide solid solution; and insulating materials having a conductive surface. Examples of the ionic conductive agent include perchlorate or chlorate of an onium such as tetraethyl ammonium or lauryl trimethyl ammonium; perchlorate or chlorate of alkali metal or alkaline-earth metal such as lithium or magnesium and the like.

The conductive agents may be used alone or in combination of at least two kinds thereof.

An addition amount of the conductive agent is not particularly restricted. However, in the case of the electronic conductive agent, an addition amount of the conductive agent is preferably in a range of from 1 part by weight to 60 parts by weight with respect to 100 parts by weight of the rubber material. On the other hand, in the case of the ionic conductive agent, an addition amount of the ionic conductive agent is preferably in a range of from 0.1 parts by weight to 5.0 parts by weight with respect to 100 parts by weight of the rubber material.

A surface layer may be formed on the surface of the charging member. Any one of resin and rubber may be used as the material of the surface layer, and the material is not particularly limited. Examples of the material include polyvinylidene fluoride, tetrafluoroethylene copolymer, polyester, polyimide, and copolymer nylon.

The copolymer nylon contains at least one species of 610 nylon, 11 nylon, and 12 nylon as a polymerization unit and 6 nylon, 66 nylon, or the like as another polymerization unit contained in the copolymer.

The total content of the polymerization unit including 610 nylon, 11 nylon, and 12 nylon contained in the copolymer is preferably 10% or more by weight.

The polymeric materials may be used alone or in combination of two or more species. The number-average molecular weight of the polymeric material is preferably in the range of from 1,000 to 100,000 and more preferably in the range of from 10,000 to 50,000.

The conductive material may be contained in the surface layer to adjust the resistance value. The particle diameter of the conductive material is preferably 3 μm or less.

As the conductive agent for adjusting the resistance value of the conductive elastic layer carbon black or conductive metal oxide particles blended into a matrix material, or a conductive material which utilizes one of electrons or ions as charge carriers, such as ion conductive agents, dispersed in a matrix material may be used.

Specific examples of the carbon black include "SPECIAL BLACK 350", "SPECIAL BLACK 100", "SPECIAL BLACK 250", "SPECIAL BLACK 5", "SPECIAL BLACK 4", "SPECIAL BLACK 4 A", "SPECIAL BLACK 550", "SPECIAL BLACK 6", "COLOR BLACK FW200", "COLOR BLACK FW2", and "COLOR BLACK FW2V" (trade names, all manufactured by Degussa Inc.), and "MONARCH 1000", "MONARCH 1300", "MONARCH 1400", "MOGUL-L" and "REGAL 400 R" (trade names, all manufactured by Cabot Corporation". A pH of the carbon black is preferably 4.0 or less.

The conductive metal oxide particles which are the conductive particles for adjusting the resistance value are conductive particles of tin oxide, tin oxide doped with antimony, zinc oxide, anatase-type titanium oxide, indium tin oxide (ITO), and the like. The conductive agent is not particularly limited, as long as it is a conductive agent using electrons as charge carriers. The particles may be used alone or in combination of two or more species. The particle diameter is not limited, but tin oxide, tin oxide doped with antimony, and anatase-type titanium oxide are preferable and tin oxide and tin oxide doped with antimony are more preferable.

Fluorocarbon-based, or silicon-based resins can be suitably used for the surface layer. Particularly, the surface layer is formed of fluorine-modified acrylate polymer. Particles may be added to the surface layer. Insulating particles of alumina or silica may be added and concave portions may be formed on the surface of the charging member to reduce a burden at the time of frictional contact with the photoreceptor, thereby improving the abrasion resistance of both the charging member and the photoreceptor.

The outer diameter of the charging member is preferably in the range of from 8 mm to 16 mm. A vernier caliper or a laser outer diameter measuring device commercially available is used to measure the outer diameter.

The micro hardness of the charging member is preferably in the range of from 45° to 60°. To lower the hardness, it is thought that a method of increasing an amount of added plasticizer is used or a low-hardness material such as silicon rubber is used.

A value measured by MD-1 HARDNESS METER (trade name, manufactured by KOBUNSHI KEIKI CO., LTD.) is used as the micro hardness of the charging member.

In the image forming apparatus according to this exemplary embodiment, the process cartridge including a photoreceptor (image carrier), a charging device (a unit of the charging member and the cleaning member), a developing device, and a cleaning blade (cleaning device) has been described, but the invention is not limited to this configuration. A process cartridge including a charging device (a unit of the charging member and the cleaning member) and further including one selected from the photoreceptor (image carrier), the exposure device, the transfer device, the developing device, and the cleaning blade (cleaning device) as needed may be used. The devices or members may not be made in a cartridge, but may be directly arranged in the image forming apparatus.

In the image forming apparatus according to this exemplary embodiment, the charging device is constructed by the unit of the charging member and the cleaning member, that is, the charging member is employed as a cleaning target, but the invention is not limited to this configuration. The photoreceptor (image carrier), the transfer device (transfer member: transfer roller), and the intermediate transfer medium (intermediate transfer belt) may be used as the cleaning target. The units of the cleaning targets and the cleaning members disposed to contact the cleaning target may be directly arranged in the image forming apparatus, or may be made in cartridges like the process cartridges and may be arranged in the image forming apparatus.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus, comprising:

an axle; and a belt-like elastic medium that is wound in a spiral shape on an outer circumferential surface of the axle and that includes a first edge portion in at least one of both ends in a width direction thereof and a second edge portion coming in contact with a surface to be cleaned at an angle different from that of the first edge portion, wherein the second edge portion is disposed to extend from one end to the other end in the width direction of the elastic medium.

2. The cleaning member for an image forming apparatus according to claim 1, further comprising a concave portion in the surface of the elastic medium, wherein the second edge portion is formed by a boundary portion between the surface of the elastic medium and the concave portion.

3. The cleaning member for an image forming apparatus according to claim 2, wherein a plurality of the concave portions are arranged in a spiral direction of the elastic medium with an interval therebetween, and wherein the plurality of concave portions are arranged so that at least a part of the surface of the elastic medium is in contact with the surface to be cleaned in the axis direction of the axle during a turn of the cleaning member.

4. The cleaning member for an image forming apparatus according to claim 2, wherein the boundary portion forming the second edge portion is curved or bent from one end to the other end in the width direction of the elastic medium.

5. The cleaning member for an image forming apparatus according to claim 1, wherein a spiral angle θ of the elastic medium is in a range of from about 10° to about 65°.

6. The cleaning member for an image forming apparatus according to claim 1, wherein a spiral width R1 of the elastic medium is in a range of from about 3 mm to about 25 mm.

7. The cleaning member for an image forming apparatus according to claim 1, wherein the elastic medium comprises foamed resin of polyurethane.

8. A charging device comprising:

a charging member that charges a medium to be charged; and the cleaning member for an image forming apparatus according to claim 1 as a cleaning member that is disposed to come in contact with the surface of the charging member so as to clean the surface of the charging member.

9. A process cartridge comprising the charging device according to claim 8 and capable of being detachably mounted on an image forming apparatus.

10. An image forming apparatus comprising:

a photoreceptor;

a charging unit that charges the surface of the photoreceptor and that includes the charging device according to claim 8;

a latent image forming unit that forms a latent image on the charged surface of the photoreceptor;

a developing unit that develops the latent image formed on the photoreceptor into a toner image by the use of a toner; and a transfer unit that transfers the toner image onto a transfer medium.

11. A cleaning member for an image forming apparatus comprising:

an axle;

a belt-like elastic medium that is wound in a spiral shape on an outer circumferential surface of the axle and that includes a first edge portion in at least one of both ends in a width direction thereof and a plurality of second edge portions coming into contact with a surface to be cleaned at an angle different from that of the first edge portion; and a plurality of concave portions in a surface of the elastic medium, wherein the plurality of second edge portions are formed by a boundary portion between the surface of the elastic medium and the plurality of concave portions, the plurality of concave portions are arranged in a length direction of the elastic medium with an interval therebetween, the plurality of concave portions are arranged so that at least a part of the surface of the elastic medium is in contact with the surface to be cleaned in an axis direction of the axle during a turn of the cleaning member, the plurality of concave portions include concave portions that simultaneously come to positions that face the surface to be cleaned during a turn of the cleaning member, and other concave portions that do not face the surface to be cleaned when the concave portions come to the positions that face the surface to be cleaned, the plurality of second edge portions are arranged on the belt-like elastic medium, and the plurality of second edge portions include second edge portions that are positioned at different positions in a rotation direction of the cleaning member but adjacent to each other in the axis direction of the axle.

12. The cleaning member for an image forming apparatus according to claim 11, wherein the plurality of concave portions include a group of first concave portions that simultaneously comes to positions that face the surface to be cleaned during a turn of the cleaning member, and a group of second concave portions that does not face the surface to be cleaned when the group of first concave portions comes to the positions that face the surface to be cleaned.

* * * * *